United States Patent [19]

Pillifant, Jr.

[11] 4,253,777

[45] Mar. 3, 1981

[54] DISPOSABLE TRAFFIC BARRICADE

[76] Inventor: Harold E. Pillifant, Jr., 3522 W. Dunlap, #214, Phoenix, Ariz. 85021

[21] Appl. No.: 80,470

[22] Filed: Oct. 1, 1979

[51] Int. Cl.[3] ..... E01F 13/00

[52] U.S. Cl. ..... 404/6; 256/64; 248/150; 40/604

[58] Field of Search ..... 404/6; 248/150; 116/63 R, 63 P; 40/584, 604, 606, 612; 256/13.1, 64

[56] References Cited

U.S. PATENT DOCUMENTS

| | | | |
|---|---|---|---|
| 2,813,456 | 11/1957 | Ostrov | 248/150 X |
| 3,065,680 | 11/1962 | Wiedman | 404/6 |
| 3,139,255 | 6/1964 | Palm | 248/150 |
| 3,209,662 | 10/1965 | Morton | 404/6 |
| 3,490,749 | 1/1970 | Anderson | 256/64 |
| 3,532,310 | 10/1970 | Finfrock | 248/150 X |
| 3,802,667 | 4/1974 | Kanan | 404/6 |
| 3,817,482 | 6/1974 | Molina | 248/150 X |
| 3,836,104 | 9/1974 | Miller | 248/150 |
| 4,104,980 | 8/1978 | Toomey | 256/64 |

*Primary Examiner*—Nile C. Byers, Jr.
*Attorney, Agent, or Firm*—Cahill, Sutton & Thomas

[57] ABSTRACT

A traffic barricade is constructed of disposable material such as cardboard and is formed of a single flat sheet of material formed into separate sheets by folding along a predetermined line. The fold forms a first and second sheet of material, each having a pair of scorelines, the first of which defines a border of a vertical area and the second of which forms a border of a horizontal area when the barricade is erected. The flat sheets each have a sloping surface between the score lines when the barricade is erected. The vertical areas of the two flat sheets formed by the folding of the single flat sheet are permanently secured to each other. The horizontal areas of each of the two flat sheets extend toward one another and one of the horizontal areas extends between the sloping surfaces of the sheets to maintain the sheets in spaced apart relation at the horizontal areas. One of the horizontal areas includes foldable edges that can be erected to an upright position to form a tray for receiving dirt or other ballast materials to anchor the barricade when it is in place.

5 Claims, 10 Drawing Figures

DISPOSABLE TRAFFIC BARRICADE

The present invention relates to traffic barricades, and more particularly, to traffic barricades of the type that are used to warn motorists and pedestrians of hazardous conditions.

Traffic barricades are well known objects in and around highways and constructions sites. Such barricades are typically made of wood and are in the form of an A-frame that may be folded to be transported on the back of a truck. The A-frames are generally formed in such a manner that they present a vertical area containing a reflective paint such that oncoming motorists can easily see the barricade by the reflected light off of the barricade from their headlights. Barricades positioned along roadways are frequently struck by automobiles or otherwise damaged in handling in transit. Such barricades are usually fairly expensive and are used in great quantities. The destruction of the barricades represents a non-recoverable expense that can amount to substantial sums when significant construction, and therefore substantial demand, is undertaken.

Attempting to cheapen the construction of such barricades usually renders the barricades either unreliable or incapable of performing their primary warning function. An additional expense encountered in the useage of prior art barricades is represented by the cost of erecting and disassembling, together with transporting, the barricades to and from the job site. For example, it is quite common for several hundred barricades to be placed along a roadway wherein construction is being undertaken, and wherein several truck loads of the barricades must be transported to the site and meticulously placed in position by the workers only to have to be retrieved by the same workmen when the job is complete. The bulk occupied by such prior art barricades requires substantial storage area and thus either several trips by a single pickup truck or several pickup trucks to gather the barricades.

It is therefore an object of the present invention to provide a traffic barricade that can be stored in a flat, thin form to occupy very little space and thus significantly reduce the transportation and storage space required.

It is another object of the present invention to provide a traffic barricade that can be manufactured very cheaply and wherein the expense of the barricade is small enough to permit the barricade to be disposed of after use.

It is still another object of the present invention to provide a traffic barricade that is readily assembleable while nevertheless providing a sturdy structure that can be discarded when the requirement for a barricade ends.

It is yet another object of the present invention to provide a traffic barricade that can cheaply yet ruggedly be constructed so that the barricade may either be disposed after useage or may easily be disassembled for reuse.

These and other advantages of the present invention will become apparent to those skilled in the art as the description thereof proceeds.

Briefly, in accordance with one embodiment of the present invention, a flat sheet of foldable material, such as cardboard, is provided with a first scoreline for folding in a first direction and a second scoreline for folding in a second direction. The first scoreline forms a border of a vertical area having light reflective material thereon while the second scoreline forms a border of a horizontal area. When the flat sheet is erected, it includes a sloping surface between the score lines. The vertical areas of two flat sheets are permanently secured together with the reflective material thereon facing in opposite directions. One of the horizontal areas extends between and is in contact with the sloping surfaces of both the flat sheets to maintain the second scorelines of each of the sheets in spaced apart relation. The horizontal area extending between the sloping surfaces is provided with edge adjacent areas that are foldable to an upright position to form a tray having a horizontal area on the bottom, having the sloping surfaces of the flat sheets on each end, and having the edge adjacent areas folded to an upright position on the sides. In this manner, a tray is formed to receive dirt or other ballast material to anchor the barricade in position.

The present invention may be more readily described with reference to the accompanying drawings, in which.

Figure 3:
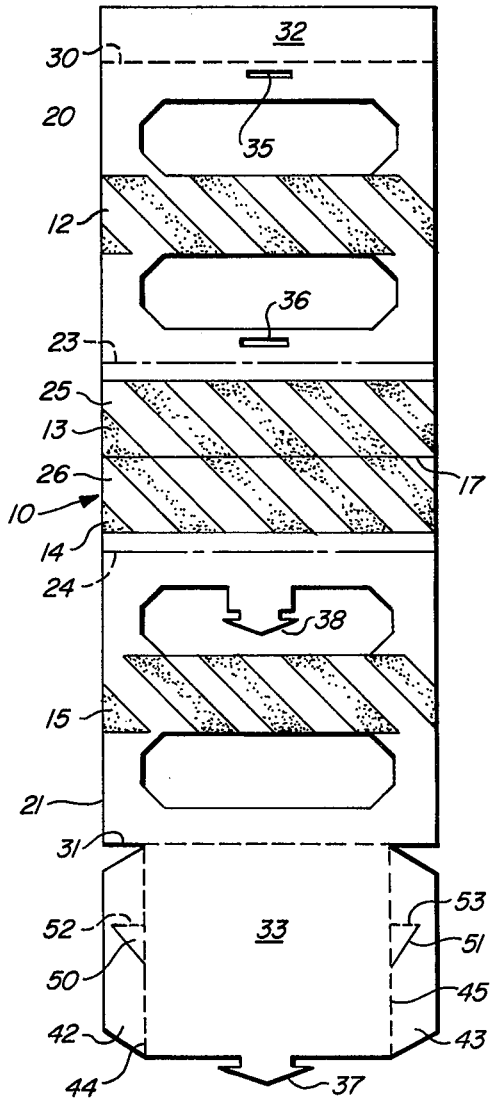
FIG. 3 is a top view of a flat sheet of foldable material formed so that it may be folded into the barricade of FIG. 1.

Referring now to the drawings, a flat sheet of foldable material 10, such as that shown in FIG. 3, is formed from cardboard or other inexpensive semi-rigid material. For example, heavyweight corrugated cardboard has been found to operate satisfactorily and can be waterproofed through the use of a wax or plastic coating in a well known manner. The flat sheet 10 may be cut from a single sheet as shown in FIG. 3 and appropriately scored or stamped using readily available paper handling machinery without the requirement for special tools or tooling. Further, when the barricade of the present invention is formed from such single sheets of flat material, they can be readily coated with reflective material, such as that shown at 12, 13, 14 and 15, using conventional techniques. Normally, the types of reflective materials or paints that are used, as well as the total area of the reflective material is dictated by highway department regulations or federal highway department rules that specify numerous criteria for such traffic barricades. The sheet of material 10 may be packaged and transported in the form shown in FIG. 3; alternatively, the sheet may be folded along fold line 17 to form a double thickness. Normally, it will be found to be more advantageous to fold the material along the fold line 17 and permanently secure the two flat sheets thus formed by the folding by stapling, such as that shown at 18 in FIG. 1 or by glueing. The reasons for such stapling or glueing will become apparent as the description proceeds.

Rather than form the barricade of the present invention out of a single sheet as shown in FIG. 3, two separate sheets may be cut and attached by staples, as described above after the folding of the single sheet. After the single sheet has been folded, or if two separate sheets are used, two flat sheets of foldable material are provided such as shown at 20 and 21. Each of these flat sheets of foldable material have a first scoreline 23 and 24, respectively, each of which, when folded, forms a vertical area 25 and 26, respectively. As mentioned previously, these vertical areas are permanently secured to the corresponding area of the other sheet of foldable material in back-to-back fashion with the reflective material thereon facing opposite directions.

Each of the flat sheets of foldable material 20 and 21 also include a second scoreline 30 and 31, respectively. The second scorelines form a border of corresponding horizontal areas 32 and 33, respectively, when the barricade is erected. It may be noted that the scorelines 23 and 24 are such that the material is folded in a first direction while the scorelines 30 and 31 are such that the material is scored in the opposite direction. Therefore, scorelines 30 and 31 are represented in FIG. 3 by dashed lines while scorelines 23 and 24 are represented by dashed dot lines. The sheet 20 is provided with slots 35 and 36 to receive locking tabs 37 and 38, respectively.

Figure 1:
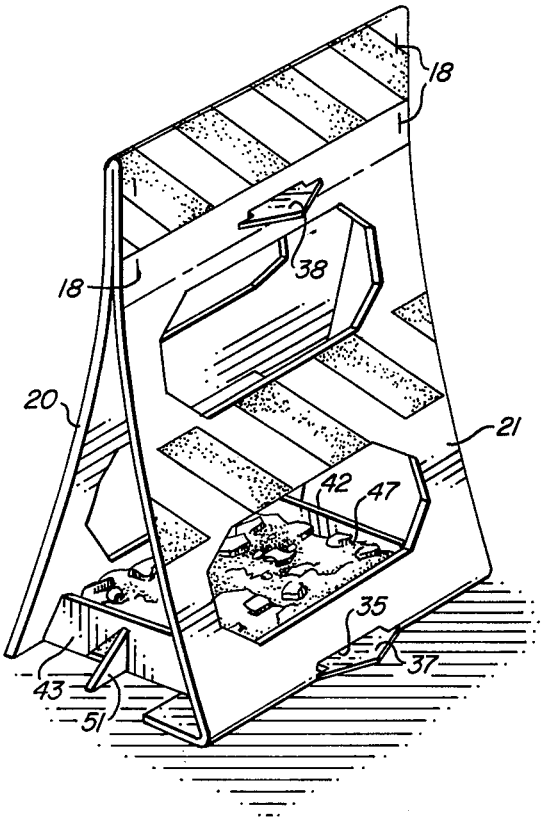
FIG. 1 is a perspective view of a disposable traffic barricade constructed in accordance with the teachings of the present invention.
Figure 2:
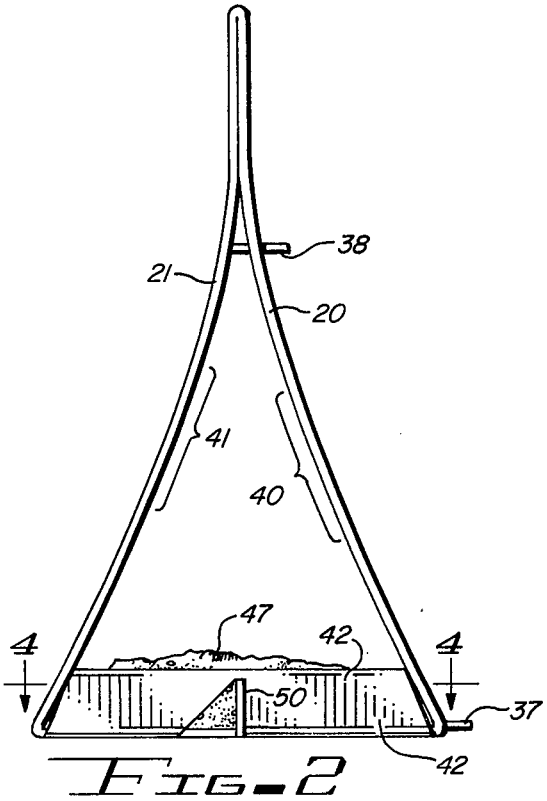
FIG. 2 is a side elevational view of the barricade of FIG. 1.
Figure 4:
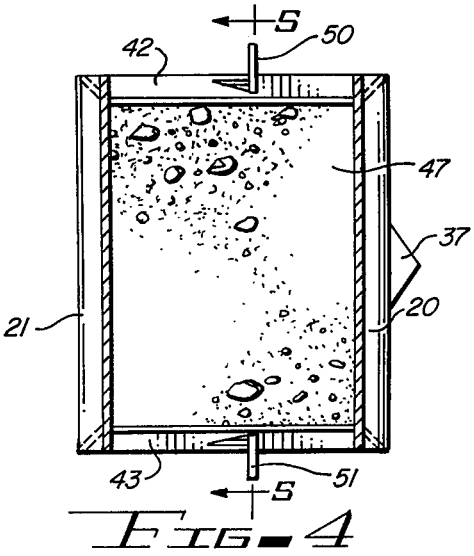
FIG. 4 is a cross-sectional view of FIG. 2 taken along line 4—4.
Figure 5:
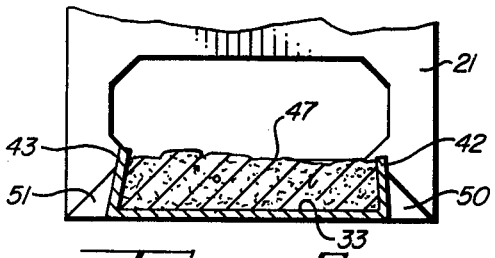
FIG. 5 is a cross-sectional view of FIG. 4 taken along line 5—5.
Figure 6:
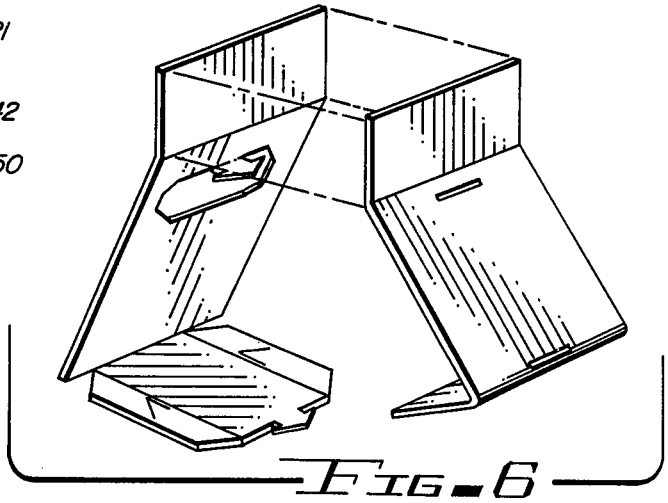
FIG. 6 is an exploded perspective view of a second embodiment of the present invention showing the utilization of two separate sheets of foldable material in lieu of the single sheet of foldable material of FIG. 3.

When the barricade is erected as shown in FIGS. 1 and 2, the horizontal areas 32 and 33 extend toward one another and overlap; since the horizontal area 33 is larger than the area 32, it extends between and is in contact with the sloping surfaces 40 and 41 of the sheets 20 and 21, respectively. By extending between the flat sheets, the horizontal area 33 maintains the second scorelines 30 and 31 in a predetermined spaced apart relation. The horizontal area 30 includes a pair of edge adjacent areas 42 and 43 that are foldable along scorelines 44 and 45, respectively, into an upright position. When in the upright position, a tray is formed (best shown in FIGS. 4 and 5) having the horizontal area 33 on the bottom, having the sloping surfaces 40 and 41 of the flat sheets on each end, and having the edge adjacent areas 42 and 43 folded to an upright position on the sides. The tray thus formed provides a receptacle for receiving dirt 47 or other ballast materials to anchor the barricade in place and permit it to withstand winds or other forces that would tend to dislodge the barricade from its designated position. It may be noted that the resulting anchored barricade has a very low center of gravity, thus presenting substantial stability and resistance to tipping.

The edge adjacent areas 42 and 43 include fold-out tabs 50 and 51 that are pivoted about substantially vertical score-lines 52 and 53, respectively, so that when the tabs are folded out, they extend in a substantially vertical plane and support the edge adjacent areas 42 and 43 in upright positions. Thus, when the tray formed by the edge adjacent areas, the sloping surfaces of the flat sheets, and the area 33 is filled with dirt, the upright edge adjacent areas 42 and 43 will be maintained in their respective upright positions against the force exerted by the dirt within the tray.

To facilitate "locking" of the sheets together and to supplement the attachment of the two sheets together, the locking tabs 37 and 38 may be inserted into their corresponding slots 35 and 36, as shown.

Figure 7:
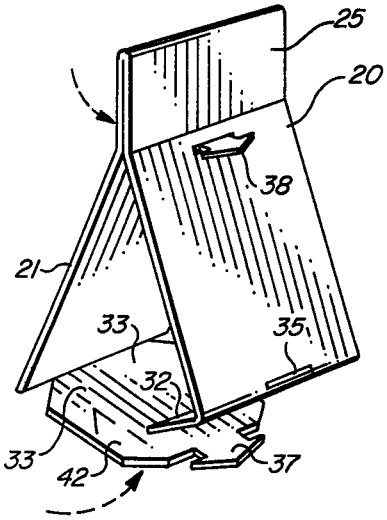
FIG. 7 is a perspective view of the foldable material of FIG. 3 shown in partially folded condition.
Figure 9:
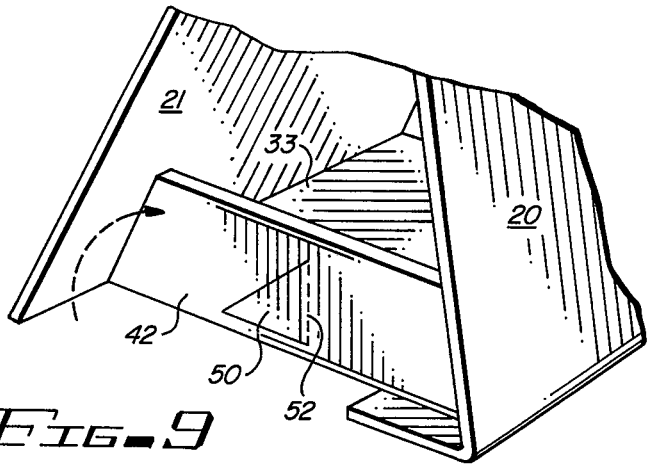
FIG. 9 is an enlarged perspective view of the bottom portion of the folded sheet of FIG. 3 showing an enlarged edge adjacent area in its folded position.
Figure 8:
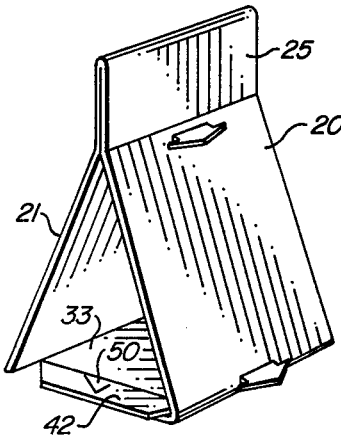
FIG. 8 is another perspective view of the foldable sheet of FIG. 3 shown in partially folded condition.
Figure 10:
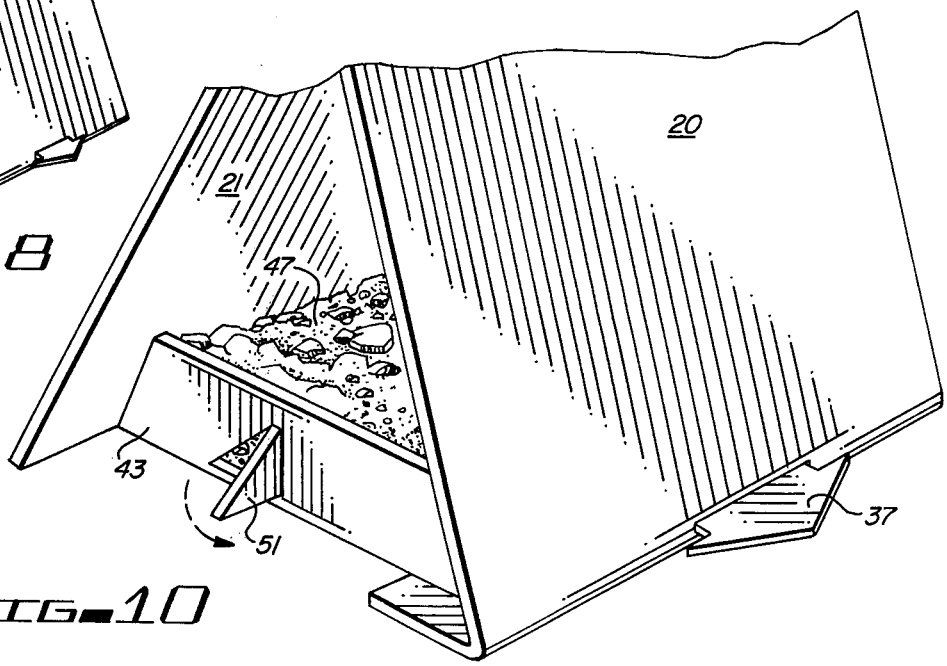
FIG. 10 is a view similar to FIG. 9 showing tabs in a folded-out position to support the upright position of the foldable edges of FIG. 9.

In use, the barricades of the present invention will normally be shipped, stacked and delivered to the job site with sheet 10 already folded along fold lines 17 to form two flat sheets of material abutting each other. In this manner, the double thickness, double flat sheet structure is very compact and requires very little room in comparison to an equivalent number of prior art barricades. Upon reaching the job site, the barricade is folded, as shown in FIG. 7, with the locking tab 38 inserted into the slot 36. The area 33 is folded along the scoreline 31 and the locking tab 37 is inserted in the slot 35, as shown in FIG. 8. The edge adjacent areas 42 and 43 are then folded along the respective score-lines 44 and 45 to an upright position, as shown in FIG. 9. The respective tabs 52 and 53 are then pivoted outwardly to assume a vertical supporting position, such as shown in FIG. 10. In this manner, the otherwise flat and compact double thickness sheet of foldable material is formed into a barricade such as shown in FIG. 1 with a tray provided at the bottom thereof for receiving dirt or other ballast material to maintain the barricade in place. The barricade may be manufactured by conventional cardboard and box manufacturing techniques with the appropriate reflective markings printed or painted thereon in inexpensive mass production machinery. The corrugated cardboard material may be resin impregnated, wax coated or coated with a water repellent resistant plastic material to permit the barricade to withstand rain and moisture. The inexpensive nature of the barricade permits the barricade simply to be disposed of when the job is completed. In the event the barricades are to be retrieved, they may simply be disassembled by reversing the steps described previously in connection with their assembly. The resulting retrieved barricade is again a flat, double thickness sheet of material that can be stacked and can be carried in a very small space. Literally hundreds of barricades constructed in accordance with the teachings of the present invention may be carried in the same space that only a few dozen prior art barricades could be carried.

A barricade constructed in accordance with the teachings of the present invention will therefore provide a very lightweight but nevertheless rugged barricade that is extremely compact. Further, the barricade will not damage vehicles that accidentally strike the barricade. This latter advantage is important in those instances where barricades may have been inadvertently misplaced and subsequently struck by an automobile, resulting in a dispute, and possible litigation, concerning damage to the automobile. The barricade of the present invention will cause minimal damage, and in most instances, no damage at all to such vehicles. In addition, the barricade of the present invention minimizes the possibility of injury to workmen handling such barricades; falling upon or being struck by a barricade will result in little or no injury. No hinges or similar structures are presented that could possibly crush or injure a workman's hand when erecting, placing or removing the barricade of the present invention.

I claim:

1. A disposable traffic barricade comprising:

a. a first flat sheet of foldable material having a first scoreline for folding in a first direction and a second scoreline for folding in a second direction, said first scoreline forming a border of a vertical area, said second scoreline forming a border of a horizontal area when said barricade is erected;

b. said first flat sheet having a sloping surface between said scorelines when said barricade is erected;

c. a second flat sheet of foldable material having a first scoreline for folding in a first direction and a second scoreline for folding in a second direction, said first scoreline forming a border of a vertical area, said second scoreline forming a border of a horizontal area when said barricade is erected, said horizontal area extending toward the horizontal area of said first flat sheet;

d. said second flat sheet having a sloping surface between said scorelines when said barricade is erected;

e. means permanently securing the vertical areas of said first and second sheets in back-to-back contact with each other with the reflective material thereon facing in opposite directions;

f. one of said horizontal areas extending between and in contact with the sloping surfaces of said first and second sheets to maintain said second scorelines in predetermined spaced apart relation; and g. one of said horizontal areas including edge adjacent areas foldable to an upright position to form a tray having said horizontal area on the bottom, having the sloping surfaces of said flat sheets on the ends, and having said edge adjacent areas folded to an upright position on the sides, thereby to provide a receptacle for receiving dirt or other ballast material to anchor said barricade against wind and other such forces.

2. The disposable traffic barricade of claim 1 wherein said first and second flat sheets are formed from a single flat sheet of material folded along a line parallel to and equidistant from said first score lines.

3. The disposable traffic barricade of claims 1 or 2 wherein one of said horizontal areas overlaps the other.

4. The disposable traffic barricade of claim 3 wherein the horizontal area including said edge adjacent areas is in contact with the ground when said barricade is erected and in place.

5. The disposable traffic barricade of claims 1 or 2 wherein said edge adjacent areas include fold-out tabs for pivoting about a substantially vertical score provided in each of said edge adjacent areas, said tabs, when in a fold-out position, supporting said edge adjacent areas in an upright position.

* * * * *